US006659744B1

(12) United States Patent
Raymond, Jr.

(10) Patent No.: US 6,659,744 B1
(45) Date of Patent: Dec. 9, 2003

(54) ROTARY TWO AXIS EXPANSIBLE CHAMBER PUMP WITH PIVOTAL LINK

(76) Inventor: Charles Dow Raymond, Jr., Box 6688, Lautoka (FJ)

( * ) Notice: Subject to any disclaimer, the term of this patent is extended or adjusted under 35 U.S.C. 154(b) by 0 days.

(21) Appl. No.: 09/836,396

(22) Filed: Apr. 17, 2001

(51) Int. Cl.[7] ..... F01C 1/063; F01C 21/16

(52) U.S. Cl. ..... 418/18; 418/29; 418/31; 418/37; 418/137; 418/138; 418/225; 418/241

(58) Field of Search ..... 418/18, 37, 15, 418/31, 225, 241, 137, 138, 29

(56) References Cited

U.S. PATENT DOCUMENTS

| | | | | | |
|---|---|---|---|---|---|
| 727,171 | A | * | 5/1903 | Mayer | 418/37 |
| 800,023 | A | * | 9/1905 | Sharpneck | 418/29 |
| 1,000,464 | A | * | 8/1911 | Vail | 418/241 |
| 1,652,609 | A | * | 12/1927 | Clarke | 418/241 |
| 1,811,729 | A | * | 6/1931 | Molkenbur | 418/260 |
| 2,068,570 | A | * | 1/1937 | Ross | 418/225 |
| 2,096,074 | A | * | 10/1937 | Stevens | 418/18 |
| 2,243,899 | A | * | 6/1941 | Fulcher | 418/138 |
| 2,272,170 | A | * | 2/1942 | Granberg et al. | 418/241 |
| 2,784,554 | A | * | 3/1957 | Badalini | 418/225 |
| 2,827,857 | A | * | 3/1958 | Eserkaln | 418/29 |
| 3,143,079 | A | * | 8/1964 | Carner | 418/24 |
| 3,185,102 | A | * | 5/1965 | Partain et al. | 418/257 |
| 3,312,200 | A | * | 4/1967 | Benson | 418/37 |
| 3,748,068 | A | * | 7/1973 | Keller | 418/241 |
| 3,797,975 | A | * | 3/1974 | Keller | 418/137 |
| 3,813,188 | A | * | 5/1974 | Neslon | 418/18 |
| 4,370,111 | A | * | 1/1983 | Shea | 418/225 |
| 4,678,413 | A | * | 7/1987 | Ries | 418/29 |
| 5,269,668 | A | * | 12/1993 | Lew et al. | 418/241 |
| 5,332,375 | A | * | 7/1994 | Kuechler | 418/138 |
| 5,440,926 | A | * | 8/1995 | Lew et al. | 418/37 |
| 5,720,241 | A | * | 2/1998 | Gail | 123/44 C |

FOREIGN PATENT DOCUMENTS

| | | | | |
|---|---|---|---|---|
| FR | 541344 | * | 5/1922 | 418/37 |
| FR | 691485 | * | 7/1930 | 418/37 |
| FR | 1.217.928 | * | 12/1959 | 418/241 |
| GB | 20816 | * | 10/1891 | 418/37 |
| IT | 288626 | * | 9/1931 | 418/37 |
| JP | 62-247194 | * | 10/1987 | 418/15 |
| PL | 47292 | * | 12/1961 | 418/37 |

* cited by examiner

*Primary Examiner*—John J. Vrablik

(57) ABSTRACT

This invention relates to expansible chamber positive displacement pumps, motors, and engines and includes variable displacement features. It provides a different method of making vane, piston, and roller abutment pumping devices which has benefits in sealing, dynamic and pressure balancing, and increased rotational speeds; resulting in better performance and higher efficiency. Since this is a technology that is parallel to existing technologies, this application is complex.

21 Claims, 6 Drawing Sheets

SECTION A–A

SECTION B–B

18B

18D

18C

ROTARY TWO AXIS EXPANSIBLE CHAMBER PUMP WITH PIVOTAL LINK

ENVIRONMENTAL BENEFITS

Figure 1A:
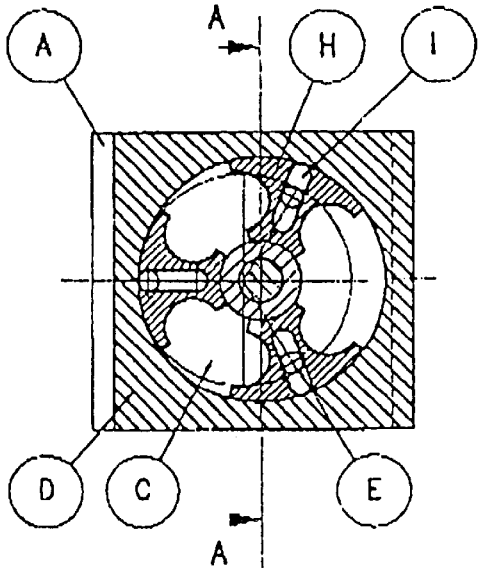

Although this invention involves a simple change in the function of parts of common machines, this can result in large benefits in energy consumption due to increased efficiency.

In general liquid pumping, the industry is dominated by centrifugal pumps. Although these pumps are "user friendly" and convenient, they are notoriously inefficient, especially at higher head pressures. Variable displacement positive displacement pumps can be much more efficient. Run as hydroelectric motors, these devices can utilize the potential energy only on demand with very high efficiency and also provide the utilization of low head sources.

The use of these devices as combustion engines could be very productive, especially as automotive engines. An improvement in efficiency in this area can have a large impact on the environment through the reduction of greenhouse gases.

The use of the heat engine as an air cycle Brayton refrigeration system could benefit the ozone layer by replacing organic refrigeration with air.

This invention relates to expansible, chamber positive displacement pumping devices having two elements rotating on different parallel axes and linked together by a third element which is also rotary about it's own axis. It is a criteria of this in invention that all three elements are dynamnically balanced about each respective axis. This will allow dynamically balanced high speed operation. Generally the three elements are:

A drive shaft -rotor element, an abutment element rotating about a central journal, in a housing and a pivoting element with links the two previous elements together, said pivot element travelling about a circular orbit around the axis of the shaft-rotor element. Several types of pumping devices may be devised using this formula; the devices are: vane pumps and motors of several distinct types, rotating radial piston pumps, rotating pistons in an annular groove, rotating elements in a groove of constant cross section, and rotating rollers in an annular groove. The latter is a simpler pump in that the roller serves both as the second and third element simultaneously so that there is only the shaft-rotor and the roller as moving parts. This is extremely simple pump.

In looking at this invention as compared to existing technology, the primary difference is that the abutments are attached to a hub at the center of the chamber, or constrained to circular motion coaxial with the chamber, whereas in other pumps, such as vane pumps, the abutments move in radial slots in the rotor-shaft element which is a simple geometry, but is flawed in that the vanes are always dynamically out of balance, and the sealing tip of the vanes is always a line contact with the cam chamber wall. By constraining the elements, such as vanes to a circular path about the chamber axis, the vanes need not touch the chamber surface but maintain a parallel tolerance seal at all times. So that the surface is not a cam.

The system is dynamically balanced and may move at higher rotational speeds. The difference here, is that in order to achieve this, the vanes cannot move in radial slots in the rotor but must move in a pivoting motion, not perpendicular to the axis of the rotor, but perpendicular to the chamber. Thus vanes, pistons, or rollers must move with circular motion which is not about the axis of the rotor, but about the axis of the chamber, This produces the precise motion but also requires the pivoting link. Generally, the pivoting link moves at a constant angular velocity with the rotor but with a changing radial distance from the axis of the rotor. With respect to the central journal, the pivot element travels at a constant radial distance from the axis of the journal, but with changing angular velocity. This geometry allows a very simple method of obtaining variable displacement. Two housing elements are fastened with the ability to slide, having one housing have shaft rotor, the other have the chamber with central journal so that as the axes are displaced, the displacement changes. This is especially valuable for increased performance and efficiency in the pumping of liquids.

The concept works for rotating radial piston technology. In this case, the pistons are always rotating about the central hub at a fixed radius but also rotating at a constant angular velocity with the rotor, again with the pivot link required. The pivot link becomes the cylinder in which the piston moves, the pivot link orbiting the rotor shaft axis, and the piston orbiting the central hub journal. In the pumping of liquids, this may allow the fluid to act directly upon rotor and hub and take almost all pressure load off the piston or pivot cylinder. Further, the device again may be variable displacement, this time by only shifting the axis of central hub. As a further benefit, the system is very simply rotary ported on the periphery of the rotor and can very simply be pressure balanced.

As a pneumatic device, the system has benefits over reciprocating technology which has two operational boundaries. The lower rpm boundary is the leakage which decreases linearly with increasing rotational speed. In this, the two technologies are equivalent. The second boundary of reciprocating engines is caused by F=ma, or that the weight of the parts increase with rotational velocity so as to cause increased friction and wear and loss of efficiency and power. In this case, the two technologies are not equivalent.

Provided each element (shaft-rotor, pistons, pivot cylinder) are dynamically balanced (about their own axis of rotation), there are no increased forces caused by increased rotational velocity. What this means is that this device becomes increasingly efficient (less leakage) with velocity rather tan less efficient. A third factor is that increased velocity causes aspiration problems in reciprocating devices due to valves springs and also size of valves not allowing air flow at velocity. In this technology, no valves are required either for intake or discharge. In the case of use as a heat engine, the device may run as a two cycle but is probably better as a four cycle, as the expansion volume may be made larger that the compression volume for higher efficiency. In this case, the compression chamber must transfer the gas into the expansion chamber through either a rotary valve or through a mechanical valve run off the center hub. Also an injector may be operated in the same way. The compression piston and expansion piston may be one part on the journal, and also include the valve and injector in the same part, and the pivot cylinder may have both compression and expansion in the same part. Thus a very simple engine can be rotor-shaft having a single pivot cylinder, and a single piston element rotating upon center journal I, and having simply open rotary ports. Thus the whole engine consists of three moving parts plus a housing. Furthermore, the center of the device constitutes a liquid pump between piston and rotor so as to accomplish both lubrication and cooling. This pumping zone may have duplex ports so that one port is pumping cooling fluid but as the chamber becomes small, the port closes and it pumps high pressure lubrication to the bearing surfaces.

In conclusion, this technology is similar and parallel with other existing technologies, but it is a simpler and more efficient way to accomplish the work, either in liquid pumping or in pneumatic applications. It can be applied to extremely wide range of products. It can also open some new doors to advanced systems, especially in fluid power transmission and also in energy conversion.

BACKGROUND; PRIOR ART

Having designed patented and built many expansible chamber pumps, it came to my attention that although my fixed displacement pumps were efficient, when load varied, the drive motor suffered in efficiency. Thus my objective was to invent a pressure regulated expansible chamber pump which would raise the efficiency of the combined pump and drive motor system. The objective was to encompass general water pumping as well as fluid power. A logical staring point was the examination of variable displacement pumps, such as axial piston pumps and single lobe vane pumps. Vane pumps appeared to have promise but had some serious drawbacks. These drawbacks were overcome by changing the manner in which the vanes operated. By pivoting the vanes from the axis of the chamber, sealing and wear problems are dismissed. To do this precluded using vanes in radial slots in the rotor. It was evident that a new criteria had to be introduced which involved a pivoting link between vanes and the driving rotor. Following this line of inquiry led to use of a similar approach for pistons and roller abutments. Because both sealing and dynamic balance was greatly improved, high rotational speeds became possible which seemed an excellent combination for pneumatic applications. Further design in both piston and vanes for pneumatic devices, including combustion engines showed promise. These designs appear to allow a much greater swept volume for size and also a much greater operating range, resulting in higher performance and efficiency.

A first liquid pump model was built which confirmed the following: variable over center (and reversible) displacement, high displacement for size, excellent sealing of chambers, precise orbits of vanes allowing pump to start pumping from stall (rather then having to rely on centrifugal force on vanes), excellent porting allowing high flow rates, smooth silent pulse free operation, no vibration indicating dynamic balance. This model confirmed most of the anticipated benefits as proof of concept. The successive designs were extensions of the basic ideas put to various industrial uses including engines.

PRIOR ART

Vane pumps are in common use in industry. This vane pump design relates most closely to vane pumps with a circular chamber rather than balanced (double) pumps. It relates to variable displacement as well as fixed displacement pumps. The main feature of this invention is that the vanes are pivoted from the axis of the circular chamber. The closet art found was a patent by Charles A Christy U.S. Pat. No. 4,073,608, Feb. 14, 1978 reference 418/241,253 in which vanes are pivoted from the center axis of the chamber and passed through pivoting vanes in a rotor and ported as a liquid pump. In Mr Christy's pump, the vanes are pivoted upon a stationary protruding journal. While the pump can be made to operate in this manner, in order to reduce wear and increase operational speed, hence performance and efficiency, the vanes must pivot about a shaft which is an idler shaft, rotating at the same essential speed as the drive shaft. Thus, the surface speed seen by Mr. Christy's vane to journal surface are about an order of magnitude greater, Mr. Christy has shown his invention as a fixed displacement liquid pump. I felt that my other design, without rotor, to be more suitable for liquid pumping. The design with rotor is more suitable for pneumatics, in large due to the availability of an internal pump for liquid which may cool, lubricate, and seal the device. Mr. Christy specifically states that this zone must be relieved to avoid pumping, probably because he only envisioned a liquid pump. As a liquid pump, the inner chambers are doing the opposite as the outer chambers. While the outer is in suction, the inner is inner discharge; obviously not ideal. Also, the pump of Christy will not handle particulate matter due to the proximity of rotor and stator in the seal zone. Nor is Mr. Christy's pump variable displacement.

EXISTING SYSTEMS

In using this technology for fluid power as in vane pump 3 or piston pump 17, I quote from Industrial Fluid Power Hodges Womack, Vol 1 page 18 discussing variable displacement single lobe pumps, "Due to the unbalanced nature of single, they are more limited in both pressure and flow than the balanced, double acting pumps to be described later. For example, maximum ratings on the pump illustrated is 21 GPM at a shaft speed of 1750, and with a pressure limitation of 1500 psi. High speed and/or high pressure will produce excessive vibration". And, on Page 183, "balanced vane pumps due to mechanical construction cannot be built to have variable displacement". In comparing the variable vane, piston, or roller pumps of this technology, we see that these pumps can have high speeds, high flow and do not have excessive vibration. Further, if we change vanes for pistons as in FIG. 17 we have a variable displacement balanced pump which has a much greater capacity than either the existing vane or piston pumps. Thus, this appears to be an extension of the fluid power technology.

In comparing the piston technology with existing reciprocating engines, we see that the basic elements are similar, however, and the basic function of compressing air, introducing fuel, and expanding is similar, however the manner in which these elements perform these functions is quite different. In the case of reciprocating technology, the pistons are driven by connecting rods by a crank shaft, obtaining reciprocating motion. The connecting rod produces side loads on the piston. In the rotary engine, the pistons are journalled to the central hub with no side loads. In the reciprocating engine, as rotational speeds increase, the pistons and connecting are subject to very high accelerations resulting in wear and friction and power loss, thus curtailing the operating range significantly and unfortunately, the curtailed portion is theoretically the most efficient portion due to less leakage.

In comparing the vane engine, again the expected curves are similar and the engine may operate on a significantly more efficient zone of the curve. These engines are significantly smaller in size for output than reciprocating devices. The rotary vane engine with divided chambers (larger expansion) allows continual open intake and exhaust ports which are very large. This is significantly better than reciprocating devices. While pistons or vanes are not subject to excessive force due to acceleration, they are subject to centrifugal force. This can be balanced by counterweights on the hinge. The same is true for the swivel elements.

OBJECTS

1. A first object is to provide a vane device in which the vanes are able to provide tolerance seating and thus avoid friction and wear.

2. A second object is to provide a liquid pump which is able to pump fluids with debris (trash pump).
3. A third object is to provide a liquid pump—motor which has variable displacement.
4. A fourth object is to provide a liquid pump—motor in which the pressure head regulates the flow.
5. A fifth object is to provide a pump—motor which is variable over center and reversible.
6. A sixth object is to provide a fluid motor in which the pressure load may increase or decrease the displacement, hence flow and cause the power to increase or decrease with the demand.
7. A seventh object is to provide a vane pump with vanes adjustable for wear and tolerance.
8. An eight object is to provide a vane pump with a flexible diaphragm material attached to and joining vanes.
9. A ninth objects is to provide a fixed displacement liquid vane pump in which the rotor provides a seal with the chamber as well as the seal between vanes.
10. An tenth objects is to provide an expansible chamber vane pneumatic device with improved sealing.
11. A eleventh object is to provide such a device with an internal liquid pump for cooling, lubrication and sealing.
12. A twelfth object is to provide a variable compression ratio compressor or expander.
13. An thirteenth object is to provide such a device as two stroke engine.
14. An fourteenth object is to provide two vane devices, linked together by gears or other as a heat engine of Brayton Cycle or Otto Cycle or refrigeration device compresses into a chamber where heat is either added or subtracted, and the working fluid is then expanded through the other vane device which is linked to the first one by gearing.
15. An fifteenth object to provide a pneumatic device with hinged pistons in which there are no accelerations on the pistons and thus the device does not have the curtailment of it's operating curve due to increasing weight of reciprocating parts and thus be more powerful and more efficient.
16. An sixteenth object to provide such as engine or compressor in which valves are simple and rotary.
17. An seventeenth object to provide such as engine having only 10% approximately of the parts of a conventional engine.
18. An eighteenth object to provide a heat engine in which the expansion volume is greater than compression volume.
19. An nineteenth object to provide a rotary hinged piston four cycle engine.
20. An twentieth object to provide such an engine to be able to function as Otto cycle, Diesel cycle, or Brayton cycle or other cycle variations.
21. An twenty first object to provide a more efficient engine due it higher rotational speeds, said engine having all moving parts in dynamic balance.
22. A twenty third object to provide a variable radial piston pump which is pressure balanced and having greatly reduced bearing requirements than other piston pumps.

ADVANTAGES

A first embodiment has the advantage of simplicity and economy while providing a sophisticated pump or motor of the expansible chamber type which can be manually variable, displacement, reversible, or can be pressure regulated. In the second embodiment, the elements are free cylindrical rollers, and wear takes place over a large surface area rather than on a line contact In the roller device, the radius of the center bushing plus the diameter of the roller equals the outer radius of the chamber. Any wear, even if it is on 4 rollers, can be adjusted by replacing the single bushing. A major advantage in this device is cost because the parts are very simple. This allows the slots to be radial in the rotor. Likewise, vanes may be the pivot elements provided the circular tips and are of sufficient width so that the contacts are always perpendicular to the chamber wall.

Another advantage is that the device can be very simply made variable displacement by only moving the two housing surfaces (which have mating planar surfaces) relative to each other and thus changing the relationship between axis of chamber cavity to axis of shaft and rotor rotation.

An advantage of the vane embodiment is that it can form a double pump. If the rotor annular ring divides the chamber. This is most useful as a vane motor in which there are two sets of intake and discharge ports. By choosing the inside chamber ports only, the displacement is lower, the rotational speed higher; by using the two ports on the outside chamber only (and bypassing the inner pumping chamber), the device has medium displacement and a medium rotational speed, by using all ports valved together, the device has higher displacement and lower speed. Thus, it has three ranges from low torque high speed to high torque low speed.

The main advantage gained by pivoting vanes on the chamber axis is a reduction in wear and friction and a positive system that doesn't rely on centrifugal for or pressure loading to insure vane to case sealing. Another advantage is in porting, where the ports can be wide open rather than as slotted ramps.

Since the ports are wide and open, in a preferred embodiment for liquid pumps there is no rotor with in the working chamber. This allows the working chambers to be large and clean of obstruction and allows a large cavity in which debris can be pumped. Further, the vanes pass the ports at right angles and there is no wedge tolerance as between rotor and chamber in which to catch debris and score the parts.

By allowing the part with chamber and hinge journal to be able to be moveable with respect to the shaft axis, then variable displacement occurs. The two axes are always parallel but can vary in distance apart. Variable displacement allows better performance and higher efficiency.

By providing the pressure output on one side of the moveable chamber and a return mechanism, such as a spring opposing said motion, the pumping device may be pressure controlled and made to provide a constant torque device despite head pressure. Such a device can have a much higher efficiency than a centrifugal pump which has much the same, (nearly constant drive torque).

If the moveable chamber can shift over center, then the pump becomes variable and also reversible, This can be valuable in power transmission or in cases where one wants to alternately provide a pressured fluid and then suck out the fluid. Also, returning to center, the device simply rotates but does not pump and has the advantage of a neutral position. If the moveable chamber is positioned at an initial displacement and spring provided on either side which can be adjusted to the initial displacement, the pressure may be applied on either side. If the pressure is applied and to decrease displacement. Then it is as previously discussed, a torque restricting device. On the other hand, if the pressure is applied in the opposite side, it causes the displacement, hence torque to increase, and hence power to increase. This is an ideal configuration for hydropower, or for fluid power where driving a generator with varying electrical loads, thus varying torque requirements. The advantage of this is that elaborate control mechanisms are eliminated. A further advantage is that the pressure fluid, a potential energy source, has been conserved as it is only used upon demand.

Another advantage is that as a fluid motor, the vane device can start from stall, unlike vane devices with vanes held out by centrifugal force and require a fairly high rotational speed before starting to pump Another embodiment provides a rotor with pivoting slots holding the vanes and the rotor is aligned in a dished out portion of the pump this be satisfactory for lubricating fluids but will probably have little advantage over the previous embodiment, however, on the other hand, using this configuration in pneumatic applications has advantages in sealing and porting.

Having the vanes travel with circular motion off a central shaft provides excellent sealing with out extreme friction. Porting through the dished out portion of the chamber allows excellent rotary porting. Allowing the central pumping chamber inside the rotor ring to pump a lubricating fluid provides a heat sink, lubrication of vanes and sealing of sliding surfaces. This allows high speed operation, less slippage, higher efficiency.

Using this concept seems to have advantages in terms of building internal combustion engines. The tolerance seal vanes approximate piston and cylinder in having parallel surfaces and with the higher speeds available with the vane device means that sealing rings may not be required due to shorter leakage time. The central lubrication and cooling pump being built in is definitely an advantage. Having the sealed zone in the dished out portion has advantages for combustion. Due to large displacement and high speed operation the power to weight ration is excellent. The device is very simple and would eliminate most parts.

By linking two vane devices together and having them share a common chamber, a Brayton cycle may be used, either as a positive displacement heat engine or as a cooling system such as an air cycle refrigeration. System compression volume may be different than the expansion volume, allowing higher efficiency. Environmentally, there are large advantages due to lower pressure combustion not producing harmful emissions and long expansion providing better efficiency and loss noise.

Similarly, an Otto Cycle or Diesel 4 stroke engine of this configuration would have many of the same advantages, sealing, cooling, different compression ratio than expansion ratio. This will have the advantage of more efficiency, less power loss due to blow down and be quieter.

There are several very important advantages of the rotating piston engine embodiment over existing reciprocating devices. The main advantage is that this device does not lose the efficiency at higher rotational speeds as does a reciprocating engine. This allows the engine become increasingly efficient with increased rotational speed due to reduced leakage per cycle.

Another major advantage is that the device is much simpler and eliminates most of the parts of a reciprocating engine, Another advantage is that this engine may have larger expansion than compression resulting in better efficiency, quieter operation, less heat loss.

Another advantage is that the engine may be operated on a number of cycles. Otto, Diesel, Brayton and also external combustion.

Another advantage is that as a Brayton, it may be run as an air cycle refrigeration device by having the combustion heat chamber instead be a heat sink.

SPECIFICATION

Figure 7:
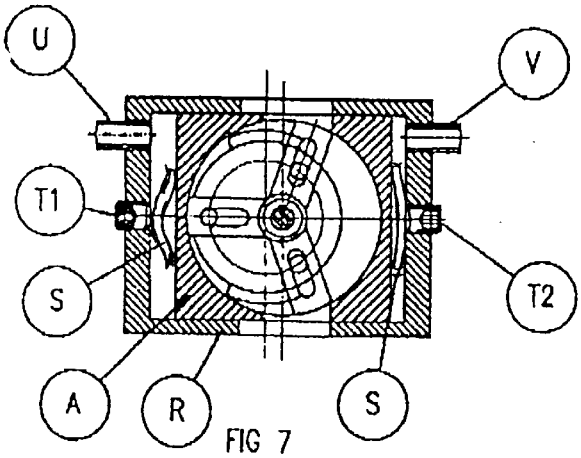

FIG. 1*a* shows a cross section of a pump which has a housing A for rotation of shaft B and rotor C. Rotor C has a planar face in the same plane as the face of housing A, but having a number of drive pins (I) extending outward from the rotor planar face. A second Housing Stator element D has a planar face which mates against the face of housing A and housing D has a chamber groove of depth F with a center hub-shaft located on the axial center and extending depth F into the chamber. Upon the hub-shaft is mounted for rotation, a bushing G. also of length F. The bushing can be of a variety of materials, including being a rubber-coated bushing. The cylindrical chamber in Housing D, then becomes an annular ring cavity with bushing G in place. An annular ring is made and cut into sectors H which fit closely in the annular cavity. Slots I are put radially in the annular sectors H, which become like pistons when the slots are fitted over the rotor drive pins. The annular sector pistons rotate about the annular circular chamber, but if the shaft axis is parallel but not coincidental with the annular chamber, the pistons H have motion relative to each other causing expanding and contracting chambers between adjacent pistons. An intake port and a discharge port may be provided either through the outer chamber wall or preferably, through the planar end of the chamber. Such ports are at the position of maximum and of minimum sub-chamber size, so the ports do not communicate. Housings A and D are fastened together in such a manner that the faces remain in close contact, but they may change their axial centers relative to each other in order to accomplish over-center reversible variable displacement. This may be accomplished by a fixed pivot between the ports and a guide-member to allow motion and a handle fixed to housing D to allow relative motion; two guides to hold the housing together in close proximity and possibly be able to roll on rollers to enable shifting under pressure, shown in FIG. 3. The variable displacement can be accomplished by either manual shifting or by attaching a piston in a cylinder working against a spring, to accomplish pressure-regulated variable displacement as shown in FIG. 7.

Figure 1B:
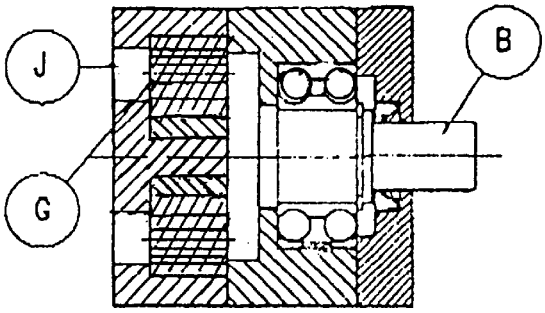

In FIG. 1B, a sectional view is shown with rotor-shaft member B for rotation in housing A and housing D having chamber C showing ports J through chamber C planar face. Not shown are other port possibilities, through the outside wall of D or through the inner hub. FIG. 1B shows a rotor housing and a rotor that is identical with FIG. 6 and the parts of FIG. 6 are interchangeable with FIG. 1 embodiment. The abutments H in FIG. 1 are interchangeable with the hinged vanes E in FIG. 6 or the housing D in FIG. 1 is interchangeable with housing A in FIG. 6.

Figure 2A:
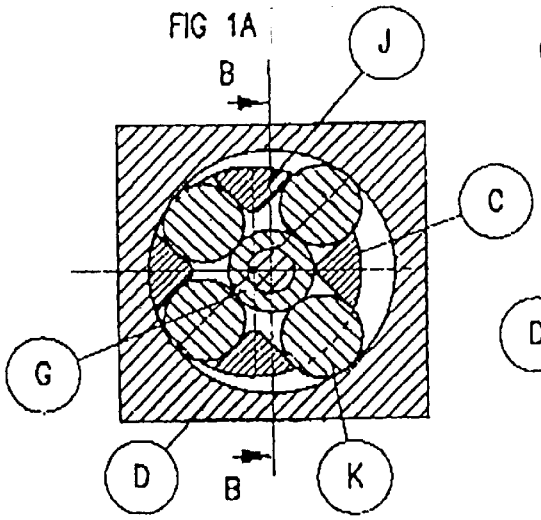

In a second embodiment (FIG. 2*a*), the rotor B is modified to extend part way into the annular chamber and the rotor has radial slots J in the extended portion, fitted to rollers K which are of a diameter of the width of the annular ring and of depth D. The rollers rotate with the rotor, maintaining a constant angular velocity, but change radial relative position during rotation. They rotate in the annular cavity at a constant radius but with changing angular velocity.

Figure 2B:
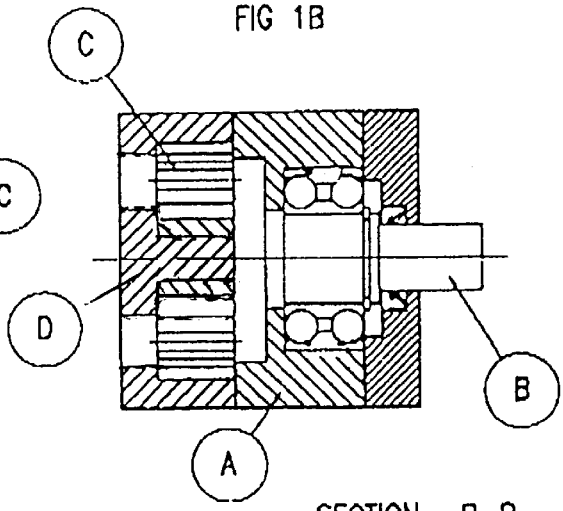

In FIG. 2B, the configuration is like FIG. 1B, such that the ports shown are through the chamber end wall but could be through any surface, except that if ported through the central hub, the bushing is eliminated.

Figure 3A:
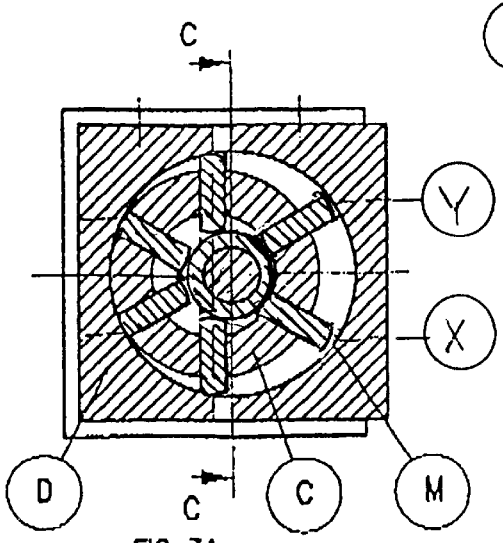

In the third embodiment, FIG. 3*a*, the rollers are modified by retaining only the diameter and changing the rollers into vanes M and the slots in the rotor are accordingly decreased in width.

Figure 3B:
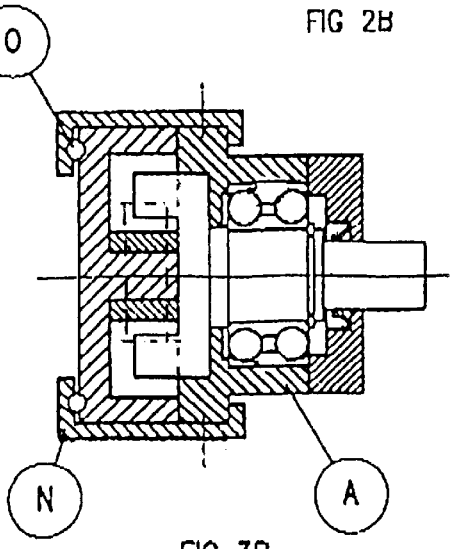

In FIG. 3B, the basic structure is the same as in FIG. 1 and FIG. 2 but, the two housings are held together by clamp N having bearings for ease of sliding motion under pressure. FIG. 3B is ported as a motor or reversible pump.

Ports are provided in the same manner, shown as between x' and X as one port zone and between Y' and Y. For variable displacement, Housing A must also have a small recessed portion equal to XX' and YY' so that the overall porting becomes XX' plus YY' plus axes displacement in order to avoid hydraulic lock at the varying positions of axes (shown as L in FIG. 6).

FIG. 3*b* shows a vane guide slot that is substantially different from other vane pumps in that the annular ring vane slot support does not divide the annular ring chamber, but only serves to guide vanes M. This changes the manner in which the pump develops the displacement. In this case, there is no seal in vane slots, and the inner chamber is connected to the outer chamber. Individual pumping chambers are formed in the volumes bounded by adjacent vanes, the outer circular chamber wall, and the inner bushing or hub surface. Vanes seal the chambers at their inner and outer circular surfaces and on the side walls. Because the rotor vane guide does not extend fully into the chamber, very large ports are allowable through any surface. Ports which are bounded by radial lines inward from XX and YY and having the width slightly less than the width of the annular chamber (so that the vanes cannot fall out of ports). In FIG. 3B the basic structure is the same as in FIG. 1 and FIG. 2 but, the two housings are held together by clamps N having bearings for ease of sliding motion under pressure. FIG. 3B is ported as a motor or reversible pump.

In embodiment 4*a*, the device has been changed to a double, or pressure balanced pump. This is generally a fixed displacement rather than a variable displacement pump. The width of the spacing between hemisphere arcs Z determines the displacement and different housing members D can have different displacements provided Z is varied. This embodiment shows porting improvement over existing balanced pumps in that two opposed ports may be put into the center hub and two outside ports come though the outer case (provided the ports leave a surface to guide the vanes). The inside ports may simply join to be a single port, generally, the discharge port as a motor or the intake port as a pump. The outer ports may be joined externally. This allows much larger available ports than current commercial vane pumps also allowing higher flow rates due to higher operating speeds being possible, allowing centrifugal pumping as well. This configuration shows pressure balancing and is a very powerful pump with low bearing loads since pressures are balanced.

Figure 4A:
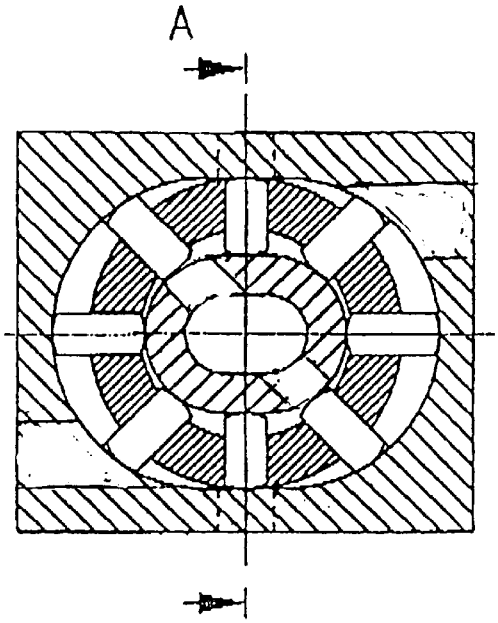
Figure 4B:
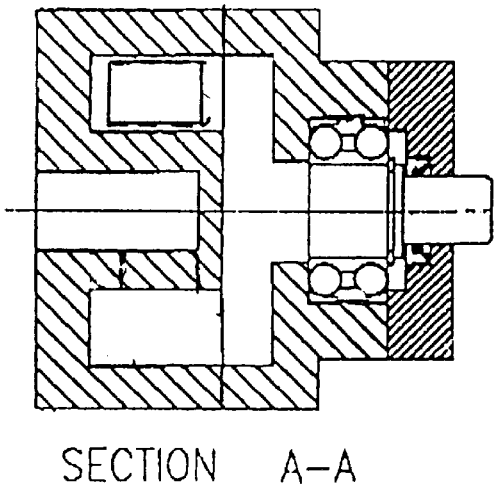

FIG. 4B shows a side view and shows a slotted rotor which is identical with FIG. 3B and also with FIG. 2B (except for the slot width). In FIG. 4B, the rotor extends into the chamber in order to drive the abutments but does not divide the chamber. This allows the chamber to be open between the inner hub and outer chamber wall, allowing fluid to communicate, this allows ports to be put through the rotor hub. FIG. 4B is ported as a single directional pump or motor. FIGS. 2B and 3B have the same configuration except that both 2B and 3B are ported as either a reversing pump or motor. If 2B or 3B is constructed as a single directional pump, the porting would be as in 4B but with the bushing eliminated. Generally, the rotor housing elements with the rotor and drive projections are the same for the FIGS. 1,2,3,4,6,7 except that the projections for 1,6,7 are pins and FIGS. 2,3,4 have slot projections.

Figure 5:
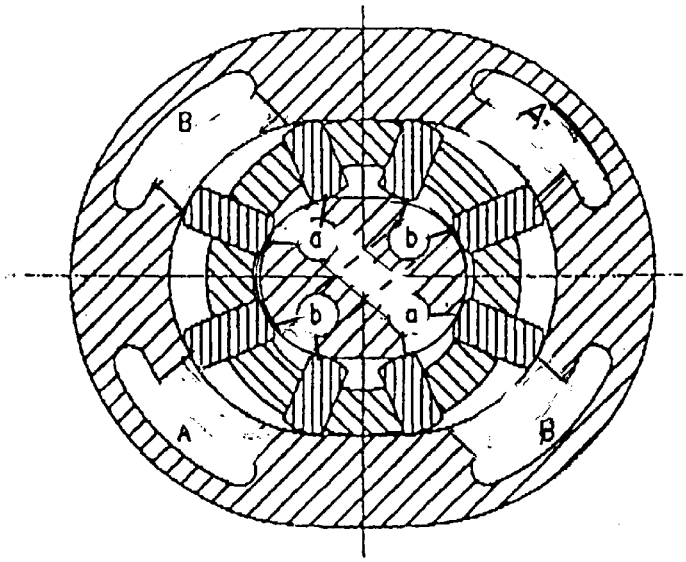
Figure 6A:
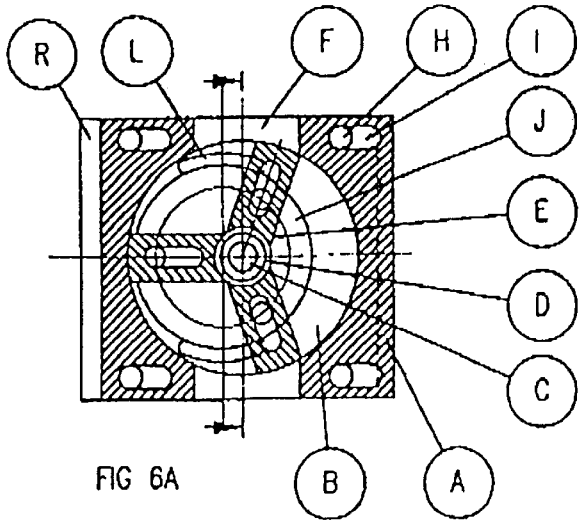
Figure 6B:
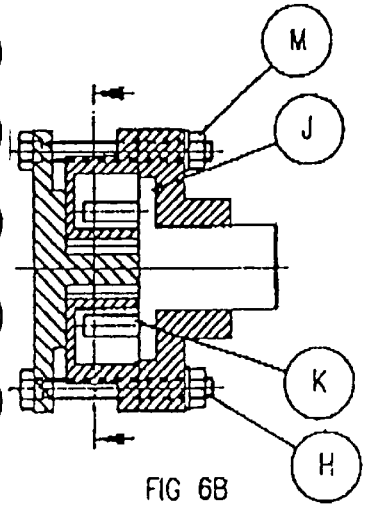
Figure 6C:
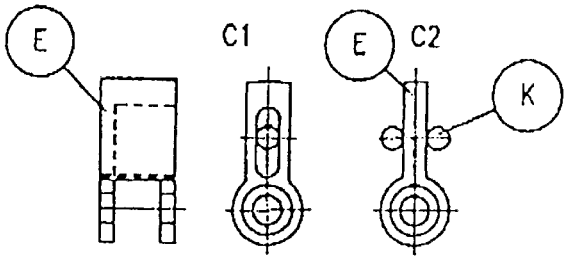
Figure 6C:
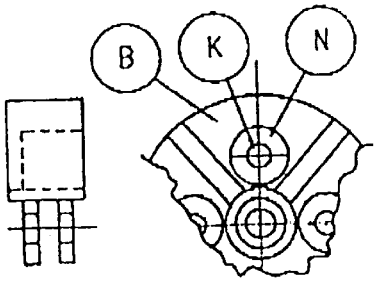
Figure 6C:
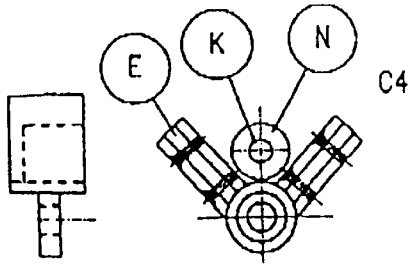
Figure 6C:
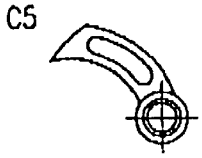

FIG. 5 shows a balanced vane pump similar in general construction to FIG. 4 except that in FIG. 5, the annular ring rotor vane guide extends the width of the chamber, dividing the chamber. Then the vane and slots become sealing surfaces, and the pump becomes divided into an inner and outer pump; the outer pump having larger displacement than the inner pump. As a balanced pump, the outer pump is ported into ports AA as either intake or discharge and ports BB as the opposite. Similarly, the inner pump has joined ports aa and bb. Then, if A and A are joined, B and B, a and a, b and b; the output of the pump (or motor) may be varied by: valving A and B together while closing AB to the pressure system, or valving AB together while closing ab to the pressure system, or by valving aa to AA and bb to BB. This provides a device with three displacement ranges, hence three torque ranges. This is especially valuable as a vane motor.

The hinged abutment has several configurations shown in FIGS. 6,7,8,9,10,11,12,13,14,15,16,17 and 18. All these figures show the abutments hinging upon a central hub (shaft) except FIG. 17 where the abutments hinge on the center abutment shaft axis but through a ring which connects the abutments. However, FIG. 17 can also be similar to the others in method, but was shown as a hinging alternative. The hinged abutment concept allows the abutments to be guided in an exact circular orbit by an idler shaft or hub, such that they do not have a contact with the outer chamber surface, which in other embodiments is a cam surface. This is a very large advantage, especially in pneumatic applications. Similarly, other abutment types could also be hinged in the same manner such as could be done in FIG. 1,2 or 3 simply by connecting the abutment to the bushing as in FIG. 6. Generally, the hinged abutments allow a parallel tolerance sealing surface, also very important for sealing. The configuration does not generally have a sealing rotor such as vane pumps do which is also an advantage.

FIG. 6, FIG. 7

(A) Chamber stator housing, adjustable, (B) Chamber bore in A, (C) Journal on bore axis, (D) Rotating bushing on C, (E) Vane with slot, hinged on D, (F) Port, (G) Stator housing for shaft, (H) Bolt, (I) Slot for H in A, (J) Shaft with drive pins, (K) Drive pins, (L) Port in [G] R, (M) O ring and groove, (N) Roller bushing, (O) Rubber diaphragm, (P) Adjustable vane faces, (Q) Adjusting screws, (R) Stator housing for shaft, (S) Spring, (T) Adjusting screws, (U) Port for pressure or suction, (V) Port for pressure or suction.

A liquid motor or pump is shown in FIG. 6. Housing A has a bored cavity B and a protruding journal C which extends the depth of the cavity, the journal having a shaft bushing D fitted for rotation. Upon bushing D are vanes (at least 2), free to rotate on the bushing and free to open and close toward each other. Since vanes E are located by journal and bushing on the axis of the chamber, they are made of a length to come in close proximity to the chamber outer diameter, the vanes being radii of the circular chamber and the vanes then being able to rotate freely within the chamber, and the vanes dividing the chamber into sub-chambers, as the vanes are of the same depth as the chamber. Housing part A has bore B which is of uniform depth and therefore has a planar surface out of which projects the journal. This describes the cylindrical annular-ring chamber, divided by vanes and one planar end. The other planar end, which encloses the chamber, is provided by shaft housing R which is bolted to housing A through slots in housing A. The slots are made to allow a shift in alignment between housing A and housing R. Housing R holds shaft J for rotation. Shaft J has drive pins K off the face which is the face of the chamber surface so that the end of shaft J is the same plane as the planar wall of the chamber, the drive pins extending into the chamber. The vanes are fitted with radial slots into which the drive pins ride such that as the shaft rotates, the drive pins propel the vanes around the chamber cavity. As the two housing stator parts are slotted for the bolt connections, the two shafts (the shaft journal and driving shaft), may lie on the same axis when the bolts are centered. In this position, the pump is in a neutral position. As the housing parts are moved away from a common axis to different but parallel axes, the device begins to pump, the direction of pumping determined by which side of center the chamber is positioned. A set of ports F in chamber housing A allow fluid to be drawn in and also a porting slot L, in the shaft housing R prevents hydraulic lock as the relative motion between the two stator housings is increased. An o-ring seal, M is provided between the stator housing parts. As the shaft rotates, the vanes pivot upon the central journal and bushing, and the angle between adjacent vanes changes with rotation. This causes a change in volumes enclosed between vanes. As the volumes change, the fluid is either drawn in or expelled through ports F. Thus, by relative manual movement between the two stator parts, the pump may vary its displacement or reverse flow direction. Vanes are hinged as shown in FIG. 6–C1, which shows a vane driven by pin K from shaft J and is also shown in FIG. 1. In this configuration, the chambers are open and clean of obstruction having chamber boundaries of vane hinge and chamber diameter wall. Having large open ports and a large open chamber allows the pump to accommodate foreign matter in the fluid and can handle fairly large foreign matter.

As a vane passes port F, any foreign matter caught between vane and stator is seen as a right angle shear between vane and stator port. By using vanes as in FIG. 6–C5, the moving vanes may strike the foreign matter at an acute angle, forcing it either back into the port or into the chamber, or shearing it off with its sharp edge.

FIG. 6–C2 shows the vane held by two pins K on either side of the vane forming a slot.

FIG. 6–C3 shows a roller, preferably with flexible surface, between vanes on drive pin K.

FIG. 6–C4 shows vanes with slots with adjustable vane surfaces and also holding a flexible rubber diaphragm between adjacent vanes. PM indicates particulate matter traversing the pumping chamber. FIG. 6B shows porting through the outer case, as a motor, but also can have ports through the chamber housing planar end, either as a motor or pump. Due to the hinges, porting for liquids is difficult through the center hub but possible for gases. FIG. 6 shows porting critical to variable displacement. There are ports through any surface in chamber housing A, but also ports recesses in the rotor housing R at L. These arcuate cavities are angularly coincident with the other ports through the chamber housing A at a zero displacement. As the chamber A moves for displacement, the effective port angle sector increases with displacement. This is not a perfect solution, since displacement is linear and ports are arcuate. It is very close however, and appears to be a satisfactory solution. FIG. 6C shows hinged vane designs. FIG. 6–C1 shows a vane with pivots and a slot for pivot on a rotor pin. FIG. 6–C2 shows the pivot vane captured between two rotor pins. FIG. 6–C3 shows a single rotor pin with a bushing being between each pair of vanes. FIG. 6–C4 shows, bolt on adjustable faces to the vane. FIG. 6–C5 shows the vane in an arc shape. This is good for a pump if the ports are through the end plate in order to facilitate filling the chamber, and as a motor, to gain energy from decreasing fluid velocities, and can also run in the opposite direction as a trash pump to chop debris. FIG. 6 can be changed into either FIG. 2 or 3 by interchanging rotors and abutments. FIG. 6 can be changed into FIG. 4 by interchanging both rotor and chamber housing. The embodiments are interchangeable with each other. Also porting determines function; such as FIGS. 1, 2, 3 show reversible pump or motor where 6 shows primarily a reversible motor porting while FIG. 4 shows a one directional pump or motor. Parts (and ports) are interchangeable. The clamp mechanism on FIG. 3 can be put on FIGS. 1, 2, 6, 8, 9, 10, etc. FIG. 7 shows FIG. 6 as a pressure regulated variable device but FIGS. 1, 2, 3, 8, 9, 10 could be substituted for FIG. 6 embodiment in FIG. 7.

FIG. 7 shows essentially the same device as FIG. 6, except that stator chamber housing A is enclosed by housing R in which housing A is allowed sliding motion. This is to allow automatic variable displacement which is caused by pressure exerted upon housing A by the fluid. The fluid pressure against housing A (fluid pressure times area) constitutes a piston and cylinder arrangement causing housing A to move within housing R with pressure. The movement is restrained by spring S. Thus two forces balance; Force= pressure x area=K (spring constant) x distance (the distance of displacement). I have shown two opposing springs and also opposing fluid pressure sources, U and V. The system is adjusted by set adjustment screws T. In FIG. 7, if rotation is clockwise, fluid will be drawn in from the top port F and discharged at the bottom port F. Spring S, has pushed part A to a position of maximum displacement as set initially by set screws T1 and T2. If port V is connected to the discharge (pressure) side, as pressure is increased, housing A will move to the left, compressing spring S1 and displacement will decrease. Thus by choosing the correct spring constant for the desired torque, a constant torque pump will result.

Conversely, if the displacement is set initially at a distance corresponding to a no load position and at rotational speed, then, if pressure is applied to port U rather than V, increased pressure will provide increased displacement hence increased power. This would be useful as a hydroelectric power source since the adjustments can be made to make the motor run at or near a prescribed rotational speed with a changing load automatically allowing energy to be supplied on demand. It does not show a side view. It is shown as a concept version that indicates that pressure fluid may be used to control the variable displacement. In FIG. 7, the moving chamber is free floating within a fixed chamber cavity, unlike the other embodiment features. Generally, the same effect could be done with pistons being attached to one housing and cylinders and springs to the other housing.

Figure 8A:
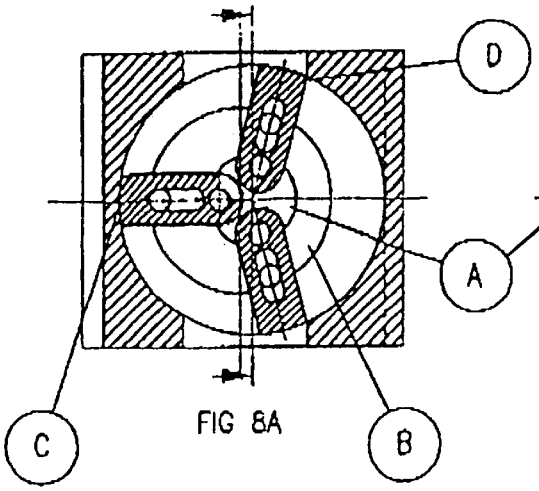
Figure 8B:
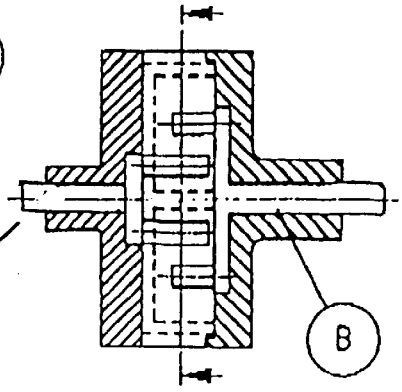
Figure 9:
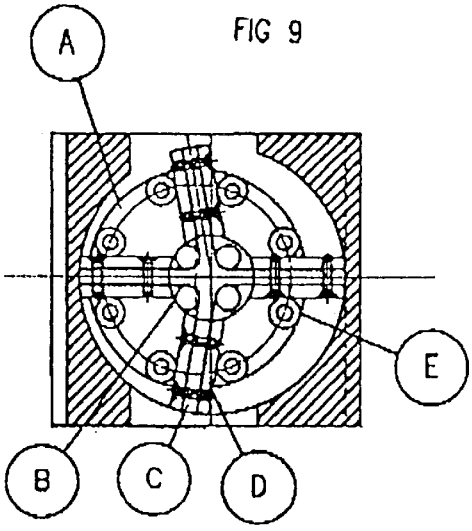

In FIG. 8, the vanes are pivoted directly on the idler shaft A, which has extending pins much like the drive shaft B. At C, the vane has its peripheral radius in close proximity to the chamber surface. At position D, only that corner at D is at the same radial distance from the axis of the chamber. FIG. 8B shows that the center pivot can be a shaft extending outside the chamber. FIG. 9 has an idler shaft B similar to drive shaft A with extending pins and the vanes are pivoted on a flexible member which passes through the axis of the chamber, and the vanes are fastened by screws through the flexible member. FIG. 9 does not have a side view but the side view is like 8B with extending shaft.

Figure 10:
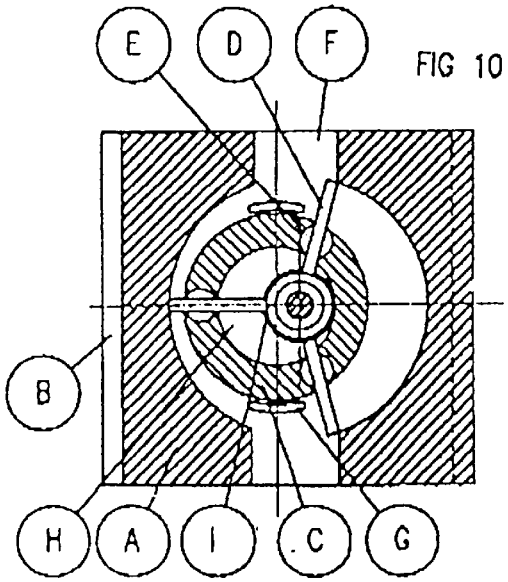

FIG. 10 shows a liquid, variable displacement pump with an annular ring rotor which may or may not extend across the chamber and has pivoting members which transmit the power from rotor to vanes. FIG. 10 does not show a side view but can be similar to FIG. 2B, except that 2B does not have pivot elements in the rotor. FIG. 10 side view also could be like FIG. 11B which shows a rotor which divides the chamber. There is a fundamental difference in porting, pressure loading and sealing as to whether or not the rotor divides the chamber. FIG. 10 is for liquids and 11A and 11B for gases.

Figure 11A:
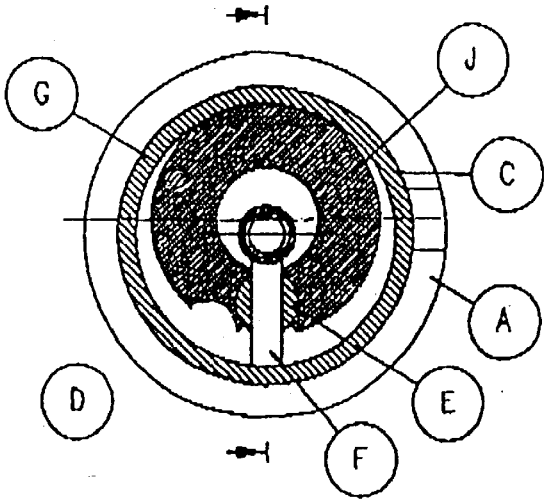
Figure 11B:
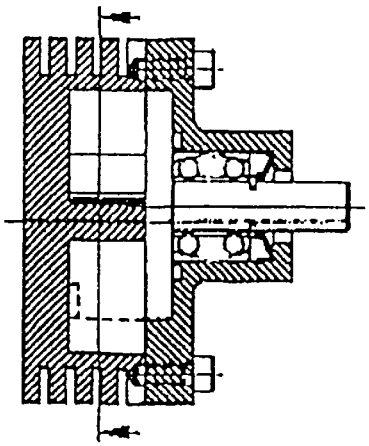

In FIG. 11, fins are provided to cool housing A. Rotor J1 is shaped within chamber B as an annular ring and the inside rotor J1 may act also as a pumping chamber with vane E being the piston. Ducts Y and Z are equipped with check valves to effect the pumping of a liquid coolant into an external heat exchanger and is drawn back into the inside chamber of B and J through duct port Z. This can provide better efficiency as the compression becomes more isothermal. Shifting the axes of the housings does not change displacement but changes the tolerance sealing between rotor and stator.

Figure 12:
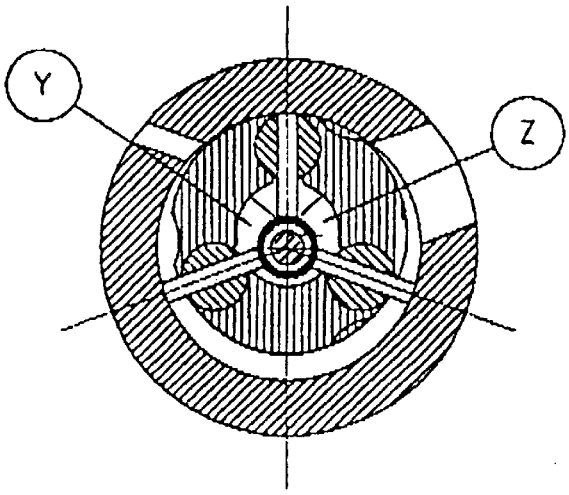

FIG. 12 shows a similar compressor-expander with 3 vanes. This device has more displacement for size and the inside liquid cooling pump may be a positive displacement with ports at Y and Z for an internal cooling pump through the chamber end, as in FIG. 3. This embodiment, having a plurality of vanes and a higher displacement is more useful as a motor or as a compressor where adiabatic compression is desired, such as in a combustion engine. FIG. 12 has no side view but is similar to 11B and is a fixed displacement compressor. The adjustment of the two housing axes is for tolerance rather than variable displacement.

Figure 13:
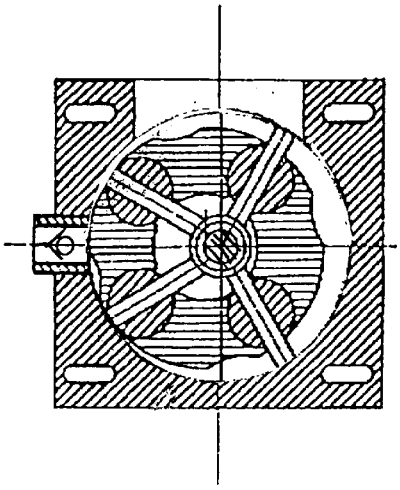

FIG. 13 shows a variable compression compressor with check valve discharge. FIG. 13 does not have a side view but is also similar to FIG. 10, except the rotor both seals and divides the chamber and the side view is similar to FIG. 11, showing a variable compressor with an interior cooling pump.

Figure 14:
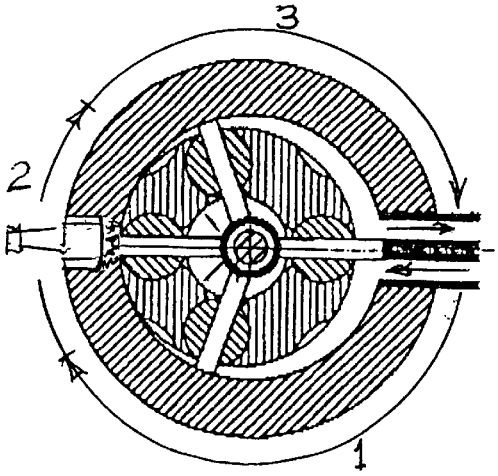

FIG. 14 shows a device as in FIG. 13 as a two-stroke engine. Shown is a 4-vane device similar to FIG. 12 or 13 with center lubricating pump at A. Such an engine must be started by an external starter. Air fuel mix will be drawn in at 1, compressed at 2, ignited at 3, combusted at 4, expanded at 5 and exhausted at 6. Both intake and exhaust should be long tube chambers to allow using the velocity of the gas to provided some valving. Rotary valving could also done for intake and exhaust if flanges are put on the rotor. FIG. 14 does not have a side view but is similar to 11B and is a variable displacement engine and shows a rotor which seals the chamber but has recessed firing chambers. Intake is shown through the outer surface but could be through the end chamber surface.

Figure 15:
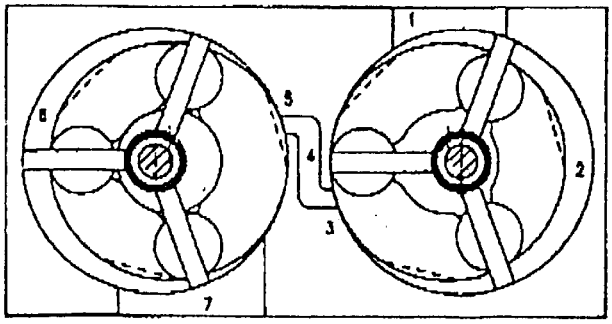

FIG. 15 shows two units as in FIG. 12 geared together and ported so that one unit is compressor and the other is expander. The fluid is drawn in at 1, compressed in zone 2, propelled into chamber 4 (rotary valved) where heat is either added or subtracted; valved and expanded at 5, expanded through zone 6 and discharged through 7. The hot side has the larger displacement.

As an Otto Cycle benzene heat engine, air and fuel may be drawn in at I by use of a carburetor, compressed and transferred to 4 where the mixture is combusted by spark plug, then valved to expander 5, expanded through 6 to exhaust at 7. The compressor size may be smaller than expander size in order to gain efficiency. Also, as a 4 stroke, air may be drawn in at 1, compressed at 2, valved into chamber 4 where fuel may be injected as with a diesel cycle, valved into expander at 5, expanded through 6, exhausted at 7.

As a Brayton Cycle heat engine, the gas is drawn in at 1, compressed at 2, valved into chamber 4, where combustion occurs in a larger chamber, than either Otto or Diesel cycle and valved into the larger expander at 5 and expanded through 6, discharged at 7. Or conversely, as a refrigeration device, air is drawn in at 1, compressed in zone 2, valved into 4 which is a heat exchanger where it is cooled, then valved into expander at 5, expanded through 6, exhausted at 7. It is desirable to use the center pumping zone near the hinge as a liquid pump as in FIG. 3 in order to cool and lubricate the device. FIG. 15 does not have a side view but the side view will be similar to 11B on both compressor and expander. A side view would show the compressor and expander linked together by gear or chain, etc.

Figure 16A:
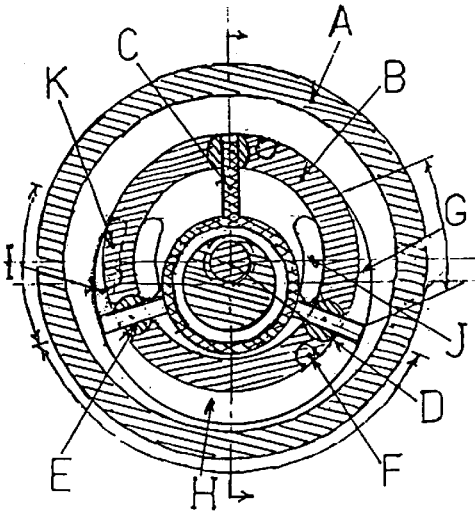
Figure 16B:
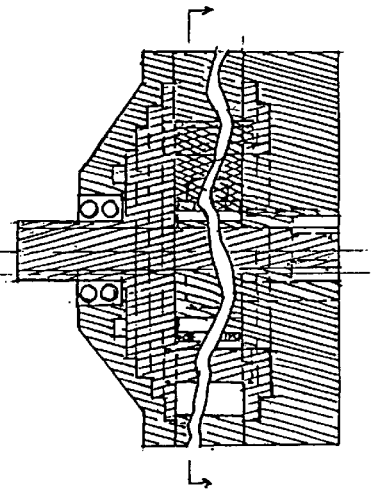

A second vane engine embodiment is shown in FIG. 16, where the compressor side and the expander side have the rotors attached to a single shaft. The compressed gas is rotary valved into a combustion chamber. The rotor flanges are extended to be larger than the working chamber for better sealing. One side shows compressor side, a broken line shortens the drawing and the other side shows expander.

Figure 17A:
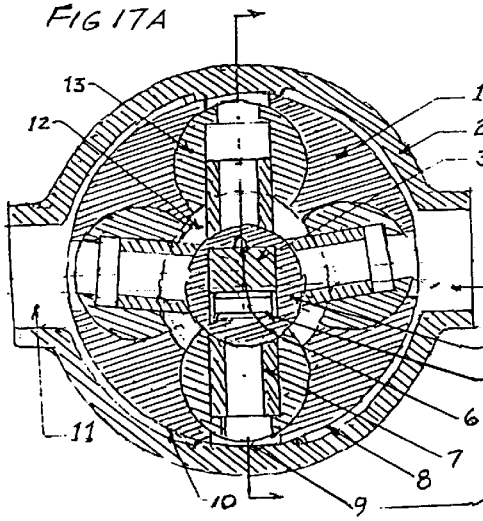
Figure 17B:
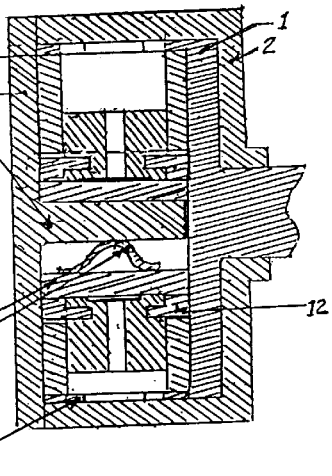
Figure 17B:
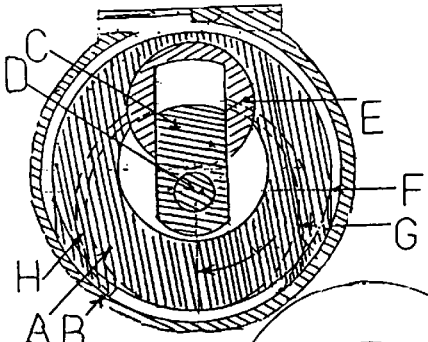

The embodiment shown in FIG. 17 shows a hinged radial piston device which is illustrated as a variable displacement liquid piston pump or motor in which all parts are very nearly pressure balanced. This differs from other vane devices in that the rotor becomes an outer circular surface which can pressure balance the rotor as well as providing rotary porting. FIG. 17B shows a side view and a manner in which the displacement may change by pressure. If the initial variable displacement is set by shifting the two housing axes, then the center hub has a spring operated pressure relief valve which can shift displacement back again and conversely, the center can be a pressure regulated displacement. The pressure relief aspect can take the place of the extended porting problem solved in other previous figures like FIG. 6 since this model is more difficult to port in that manner.

FIG. 17A shows a shaft and rotor 1 for rotation within housing 2. Housing 2 has a rectangular central hub 3 on which is put circular journal 4 having a rectangular slot which fits said central hub on two sides but is larger in the other direction by the axis offset plus the compressed width of a leaf spring 5 which opposes a chamber with pressurized fluid from orifice 6 in order to provide a means of regulating the position of journal 3 by pressure and thus regulate the displacement of the pump. Rotor 2 has circular receptacles into which swiveling cylindrical elements 13 are fitted. The cylindrical elements 13 have rectangular (or cylindrical) cavities into which pistons 7 are fitted. Pistons 7 are hollow, allowing the fluid within the chamber to communicate with the journal 4 as well as rotor 1. This eliminates the need for a bearing between pistons 7 and journal 4 and at the same time the forces are removed from cylindrical pivot chamber 13. As the device rotates, the open ports 9 at the circumference of rotor I communicate with ports 8 and 10 and intake and discharge are at 11 and 14. Pistons 7 have circular sector slots in their sides into which fit ring-hinged bearings that form a hinge between the pistons and the center cylindrical hub between pistons 7 and journal 4. The journal 4 is a separate piece in this embodiment and provides the variable displacement rather than moving the housing and chamber with hub. It should be noted that the motion of journal 4 could be done manually as well. As rotor 1 is symmetrical, it is dynamically balanced. Swivel chamber elements 13 are dynamically balanced about their axis of rotation. Vanes 7 can be only totally dynamically balanced if the hinge journals are attached to the pistons as with vanes in previous embodiments. However, pistons 7 may be hollow and of very little mass so that imbalance will be negligible if the journal bearing rings are used.

Figure 18A:
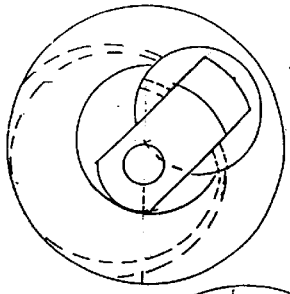
Figure 18A:
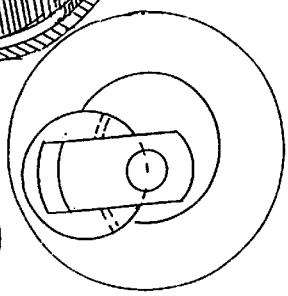
Figure 18A:
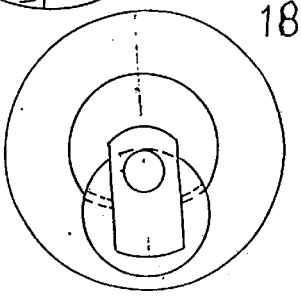

Another embodiment of the piston concept is shown in FIGS. 18 A,B,C and D. This shows the basis for a single piston engine or compressor. Housing 1 has a cylindrical cavity fit with swivel chamber member 3 into which fits piston 4 which rotates freely about journal 5 which is attached to housing 1 on an axis parallel to the axis of rotor 2. Shown also is that journal 5 may pass through housing 1 and be the throw on a shaft which may be slightly rotated in order to provide advancing or retarding the cycle. As the system rotates, there is expansion and contraction of the volume between piston and swivel cavity member. Also, as the system rotates, note that the positions 7 and 8 change is sinusoidal. This allows porting between chamber and rotor and there may also be rotary ports between rotor and the housing. If the rotating elements are all balanced about their respective axes of rotation, the machine is in dynamic balance. Each rotating element has bearing means. Seals may be provided between sliding parts as is commonly done. Swivel chamber element 3 encloses the volume of the piston ends as well. As a 2 cycle engine, rotor 2 may have air scoops and ducts into swivel member 3, where air may be introduced as a blower through ports in swivel member 3. Generally, intake and discharge may be valved radially outward through swivel member 3 and rotor 2 such as. at 7 and 8 by providing a rotary port. FIG. 18 does not show any side view. The side view would be similar to 17B except without the pressure relief spring and the center hub. It shows a variable compression device by shifting housing members. Both FIG. 17 and FIG. 18 differ from other pumps in that there is no groove chamber, i.e., that the groove volume is zero and the former chamber housing has only the end flange and center hub to shift for variable displacement.

For models with more pistons and swivel members, the pistons are hinged on the hub.

As a variable displacement liquid pump, FIG. 18 can be ported through the housing end-plate in a manner similar to FIG. 2.

I claim:

1. A rotary device having a first housing with a rotor and a shaft mounted for rotation within the housing; the housing and rotor having a common planar face; a second housing, also with a planar face, which is fitted to the first housing in a sealing manner but able to shift the axes of the two housings relatively; the second housing having a grooved chamber, the chamber being of rectangular cross section and of constant width and depth; the chamber having a chamber surface on an inner hub, an end planar surface, an inner chamber surface on an outer portion of the second housing; the chamber being fitted with abutments which seal and subdivide the chamber between the two housings into sub-chambers; the rotor face having projections which extend axially into the chamber, which do not seal but which are fitted to engage and drive the abutments around the chamber at rotor velocity; the abutments having a shape so as to pivot with respect to the rotor drive projections and to the chamber while always maintaining sealing perpendicular surfaces with walls of the chamber; the second housing having inlet and discharge ports through any chamber surface, inner, outer or planar; such that the inlet and discharge ports do not communicate; the first housing also having two arcuate recessed ports located at the outer periphery of the rotor face, such that the arcuate ports communicate with the second housing ports in order that at no position of the axis shift is fluid trapped inside the sub-chambers of changing volume.

2. The device as in claim 1 as a pump or motor, in which a low pressure port is through the radially inner hub chamber surface and a high pressure port is through the radially outside chamber surface and that the inner surface always communicates with the outside surface within a sub-chamber.

3. The device as in claim 1 as a pump or motor, in which both inlet and discharge ports are through the chamber planar end surface.

4. Device as in claim 1 as a pump or motor in which a low-pressure port is through the planar end surface and a high-pressure port is through the radially outer chamber surface.

5. The device as in claim 1 as a pump or motor in which there are two pumping zones as a pressure balanced double pump, having two low-pressure ports through the chamber inner hub and having two high-pressure ports through the radially outer chamber surface and, where the inner hub surface communicates with the outer chamber's inner surface.

6. The device as in claim 1 as a pump in which the inlet port is through the chamber planar surface; a discharge port through the inner hub surface and also having a second discharge port through the outer chamber surface constituting a pump which can separate matter having differing specific gravity.

7. The device as in claim 1 as a pump or motor, in which the abutments have parallel sealing surfaces with the chamber walls and which pivot relative to the rotor drive projections.

8. The device as in claim 1 as a pump or motor in which the abutments pivot with respect to the chamber inner and outer surfaces.

9. The device as in claim 1 as a pump or motor, in which the abutments are hinged for rotation about the inner hub.

10. The device as in claim 1 as a pump or motor in which the displacement is varied by fluid pressure action against a spring by having one housing joined to a cylinder type cavity and the other housing joined to a piston projection in a sealing sliding manner, and a fluid duct from the pressure side of the pumping chamber.

11. The device as in claim 1 as a pump or motor, in which the two housings are shifted manually for variable displacement.

12. The device as in claim 1 as a pump or motor, in which the inner hub is an idler shaft fixed for rotation in the chamber which has hinged abutments attached to the idler shaft.

13. The device as in claim 1 as a pump or motor, in which the inner hub is the shaft fixed for rotation in the chamber housing and, the shaft also has a planar face with the chamber end wall and, the shaft has pins extending from the planar face across the chamber and, the abutments are attached by flexible diaphragm type material sandwiched between rigid abutment radial surfaces such that the abutments are pivoted at the axial center by the diaphragm material which provides both pivot and sealing of the chamber and, the ports may be provided through either the radially outward chamber surface or the chamber planar end wall surface.

14. A device as in claim 1 as a variable displacement pump, in which the inlet port is through the inner hub and the discharge port is through the outside chamber surface and where the fluid adjacent to the inner hub surface always communicates with fluid adjacent to the outside surface, providing two distinct pumping actions; one being variable positive displacement and the second being a velocity pumping function dependent on centrifugal force; such that the two pumping disciplines are joined and form a new pumping curve where flow is a function of the variable positive displacement which is a function of the two housing axes offset and of rotational speed; and where the velocity part of the pressure-flow performance curve is proportional to the square of the rpm and where for a given rotational speed, the displacement can be varied to choose a value in order to generate a flow-pressure curve which is hyperbolic in shape and which curve describes a condition where the flow times the pressure is nearly a constant for most of the curve regardless of the head pressure; and to choose a curve which provides nearly constant torque to the drive motor.

15. The device as in claim 1 as a pneumatic pump or motor, in which a low pressure port is near the position of maximum sub-chamber displacement and a high pressure port is near the minimum sub-chamber position allowing a high compression ratio and that the axes of the housings are shifted by pressure such that the torque remains relatively constant.

16. The device as in claim 1 as a pneumatic pump or motor having abutments pivoting from the inner hub and having a low pressure port near the position of maximum sub-chamber volume and a high pressure port being smaller and located near the position of minimum sub-chamber volume, and having abutments such that at the minimum volume position, the minimum volume approaches zero which means the adjacent abutments nearly touch each other at the minimum volume and, the variable displacement feature is activated such that the drive or driven torque remains essentially constant.

17. The device as in claim 1 as a pneumatic pump, in which the rotor is extended across the chamber dividing the chamber, and having pivoted hinged abutments and sealing pivoting slots in the rotor through which the abutments pass, and the chamber having a dished-out portion in which the abutment tips do not seal but the rotor seals against a housing, the seal tolerance regulated by the sliding of the two housings, the rotor housing not being ported for variable displacement, the second housing being ported for maximum intake sub-chamber volume and with a rotary port discharge through the dished-out housing portion, with the rotor having a peripheral recess as a duct into the discharge port.

18. The device as in claim 1 as an engine having hinged abutments and not having an arcuate recess in the first housing, having a combustion means near the position of maximum compression and both inlet and discharge ports.

19. The device as in claim 1 in which the rotor projections extend and divide the chamber and the rotor projections have pivot slots through which hinged abutments pass in a sealing, sliding manner so the abutments divide both the sub-chambers into inner and outer sub-chambers; such that the outer sub-chambers between rotor and outer chamber surface provide a pneumatic pump; while the inner sub-chambers pump a cooling and lubrication fluid; and the outer sub-chambers having inlet and discharge ports; and the inner pumping sub-chambers also having separate inlet and discharge ports.

20. A device as in claim 1, wherein the rotor projections extend, seal and divide the chamber and which has one or more abutments pivoting off the inner hub and in which the chamber has a dished out portion where the rotor seals against the outer dished out portion of the chamber and where the movement of the two housing axes is for tolerance purposes rather that to vary the displacement, and the first housing doesn't contain recessed connecting ports.

21. The device as in claim 1, as a motor, such as used for hydroelectric power generation, in which the high pressure inlet is through the outer chamber surface and the low pressure discharge is through the inner chamber hub surface, in order to fully utilize the energy both as a positive displacement motor and as a fluid velocity change motor, and so that with a constant head pressure but variable load requirements, the variable displacement is changed to match load conditions in order to utilize power on demand.

* * * * *